US009879675B2

(12) United States Patent
Takashima et al.

(10) Patent No.: US 9,879,675 B2
(45) Date of Patent: Jan. 30, 2018

(54) ROTARY COMPRESSOR AND REFRIGERATING CYCLE APPARATUS

(71) Applicant: Toshiba Carrier Corporation, Kanagawa (JP)

(72) Inventors: Kazu Takashima, Fuji (JP); Hisataka Kato, Fuji (JP); Keiichi Hasegawa, Fuji (JP); Masahiro Hatayama, Fuji (JP)

(73) Assignee: TOSHIBA CARRIER CORPORATION, Kanagawa (JP)

( * ) Notice: Subject to any disclaimer, the term of this patent is extended or adjusted under 35 U.S.C. 154(b) by 367 days.

(21) Appl. No.: 14/553,585

(22) Filed: Nov. 25, 2014

(65) Prior Publication Data

US 2015/0078933 A1 Mar. 19, 2015

Related U.S. Application Data

(63) Continuation of application No. PCT/JP2013/071692, filed on Aug. 9, 2013.

(30) Foreign Application Priority Data

Aug. 9, 2012 (JP) ..... 2012-177223

(51) Int. Cl.
*F04C 18/332* (2006.01)
*F01C 21/08* (2006.01)
(Continued)

(52) U.S. Cl.
CPC ..... *F04C 18/332* (2013.01); *F01C 21/0845* (2013.01); *F01C 21/0881* (2013.01);
(Continued)

(58) Field of Classification Search
CPC .... F04C 18/332; F04C 18/3564; F04C 23/02; F04C 2270/17; F04C 23/008;
(Continued)

(56) References Cited

U.S. PATENT DOCUMENTS 4,086,042 A * 4/1978 Young ..... F04C 18/3566 418/139
4,514,154 A 4/1985 Mazzagatti
(Continued)

FOREIGN PATENT DOCUMENTS

CN 1932295 A 3/2007
CN 1950611 A 4/2007
(Continued)

OTHER PUBLICATIONS

Notification of Transmittal of the International Search Report and the Written Opinion of the International Searching Authority, or the Declaration, including an International Search Report and Written Opinion of the International Searching Authority, dated Nov. 19, 2013 in connection with PCT International Application No. PCT/JP2013/071692, filed Aug. 9, 2013.
(Continued)

*Primary Examiner* — Essama Omgba
*Assistant Examiner* — Stephen Mick
(74) *Attorney, Agent, or Firm* — John P. White; Cooper & Dunham LLP

(57) ABSTRACT

According to one embodiment, a rotary compressor accommodating an electric motor portion and a compression mechanism portion in a sealed case, wherein the compression mechanism portion comprises a cylinder, a roller, and a vane. The vane is disposed by stacking two divided vanes in a height direction of the cylinder, which is an axis direction of the rotation axis, and where a height dimension of one divided vane is H, and a minute gap between a height dimension of the cylinder and a height dimension of the two stacked divided vanes is L, a proportion of the minute gap L to the vane height dimension H per one divided vane is $0.001 < L/\text{number of divided vanes}/H < 0.0015$.

10 Claims, 11 Drawing Sheets

(51) Int. Cl.

| | |
|---|---|
| ***F04C 23/02*** | (2006.01) |
| ***F04C 18/356*** | (2006.01) |
| *F04C 23/00* | (2006.01) |
| *F04C 27/00* | (2006.01) |

(52) U.S. Cl.
CPC ..... *F04C 18/3564* (2013.01); *F04C 23/02* (2013.01); *F04C 23/001* (2013.01); *F04C 23/008* (2013.01); *F04C 27/002* (2013.01); *F04C 2270/17* (2013.01)

(58) Field of Classification Search
CPC ..... F04C 23/001; F04C 27/002; F04C 2/332; F04C 2/3566; F04C 18/32; F01C 21/0845; F01C 21/0881; F01C 1/46; F01C 21/0809; F01C 21/0827
USPC ..... 417/410.3; 418/11, 60, 248–249, 251, 418/83, 84, 85, 97, 99, 100
See application file for complete search history.

(56) References Cited

U.S. PATENT DOCUMENTS

| | | | | |
|---|---|---|---|---|
| 6,250,899 | B1 * | 6/2001 | Lee | F01C 21/0809 418/63 |
| 7,438,541 | B2 * | 10/2008 | Aya | F04C 23/008 184/6.18 |
| 2008/0193314 | A1 * | 8/2008 | Cho | F01C 21/0863 418/58 |
| 2009/0010790 | A1 | 1/2009 | Maeng | |
| 2012/0039735 | A1 * | 2/2012 | Lee | F01C 21/0818 418/63 |
| 2013/0202470 | A1 * | 8/2013 | Liang | F01C 1/3442 418/104 |
| 2013/0280116 | A1 * | 10/2013 | Hayashi | F01C 21/08 418/55.2 |

FOREIGN PATENT DOCUMENTS

| | | | |
|---|---|---|---|
| CN | 101925743 | A | 12/2010 |
| CN | 102549266 | A | 7/2012 |
| EP | 2428641 | A2 | 3/2012 |
| JP | S57 212393 | A | 12/1982 |
| JP | 2-196184 | A | 8/1990 |
| JP | 8-21388 | A | 1/1996 |
| JP | 2010-121448 | A | 6/2010 |
| JP | 4488104 | B2 | 6/2010 |
| WO | WO 2009/093701 | A1 | 7/2009 |

OTHER PUBLICATIONS

Notification of the First Office Action dated Jan. 11, 2016 in connection with Chinese Patent Application No. 201380030451.3, filed Aug. 9, 2013.

Supplementary European Search Report dated Jan. 22, 2016 in connection with European Patent Application No. 13828051, filed Aug. 9, 2013.

Notification of Transmittal of Translation of the International Preliminary Report on Patentability (Chapter I or Chapter II), including an International Preliminary Report on Patentability and Written Opinion of the International Searching Authority, dated Feb. 19, 2015 by the International Bureau of WIPO in connection with PCT International Application No. PCT/JP2013/071692, filed Aug. 9, 2013.

* cited by examiner

ROTARY COMPRESSOR AND REFRIGERATING CYCLE APPARATUS

CROSS REFERENCE TO RELATED APPLICATIONS

This application is a Continuation Application of PCT Application No. PCT/JP2013/071692, filed Aug. 9, 2013 and based upon and claiming the benefit of priority from Japanese Patent Application No. 2012-177223, filed Aug. 9, 2012, the entire contents of all of which are incorporated herein by reference.

FIELD

Embodiments described herein relate generally to a rotary compressor and a refrigerating cycle apparatus comprising the rotary compressor and constituting a refrigerating cycle.

BACKGROUND

Refrigerating cycle apparatuses comprising rotary compressors are often used. In a rotary compressor of this type, an electric motor portion and a compression mechanism portion are joined through a rotation axis, and the compression mechanism portion is provided with a cylinder in which a cylinder chamber is formed, a roller moves eccentrically within the cylinder chamber, and a vane abutting the roller, the vane partitioning an inside of the cylinder chamber into a compression chamber and an intake chamber.

When the rotation axis rotates and the roller moves eccentrically within the cylinder chamber to compress a gas refrigerant that has been taken in, the pressurized gas refrigerant presses the roller and the rotation axis, and the rotation axis bends slightly. Then, the roller inclines and enters a so-called partial contact state in which a contact surface between the vane and the roller is uneven and they contact locally, a sliding resistance at a contact portion between the vane and the roller is increased, and friction progresses (for example, Japanese Patent No. 4488104).

DETAILED DESCRIPTION

In general, according to one embodiment, to improve reliability by dissolving a partial contact of a vane with a roller and relaxing a local contact pressure, it is effective to dispose a vane, dividing it into two vanes. That is, because the two vanes each enter a state of sliding slightly, contact force on a sliding surface between the roller and the divided vane can be dispersed and sliding friction can be restrained to improve reliability.

However, in an ordinary structure in which one vane is provided, if the proportion of a minute gap appearing because of a difference in height between a cylinder and the vane to a height dimension of the vane is set too small, a movement of the vane is worsened, and a sliding loss is increased. If the proportion of the minute gap is set too large, an amount of a leaked gas refrigerant from a compression side to an intake side in a cylinder chamber is increased, and a leakage loss is increased.

Under such circumstances, there has been a desire for a rotary compressor in which a vane is divided into two vanes, a leakage loss of a gas refrigerant to an intake chamber from a compression chamber in a cylinder chamber is restrained, and a smooth movement of a roller can be surely obtained without an increase in a sliding loss between the divided vanes and the roller; and a refrigerating cycle apparatus comprising the rotary compressor.

In a rotary compressor of an embodiment, an electric motor portion and a compression mechanism portion joined to the electric motor portion through a rotation axis in a sealed case, wherein the compression mechanism portion comprises a cylinder comprising a cylinder chamber, a roller moving eccentrically within the cylinder chamber, and a vane abutting the roller and partitioning an inside of the cylinder chamber into a compression chamber and an intake chamber.

The vane is disposed by stacking two divided vanes in a height direction of the cylinder, which is an axis direction of the rotation axis, and where a height dimension of one divided vane is H, and a minute gap between a height dimension of the cylinder and a height dimension of the two stacked divided vanes is L, a proportion of the minute gap L to the vane height dimension H per one divided vane is $$0.001<L/\text{number of divided vanes}/H<0.0015.$$

An embodiment will be described hereinafter with reference to the accompanying drawings.

Figure 1:
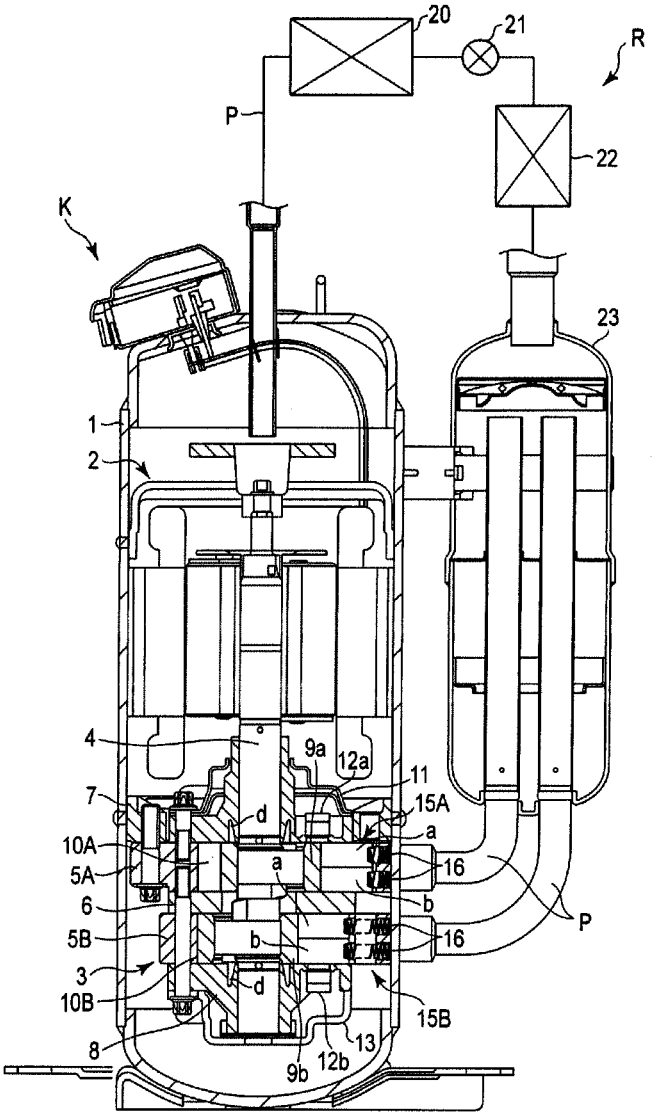
FIG. 1 is a longitudinal sectional view of a rotary compressor and is a schematic refrigerating cycle structural view of a refrigerating cycle apparatus according to a present embodiment.

FIG. 1 is a schematic longitudinal sectional view of a two-cylinder-type rotary compressor K and is a structural view of a refrigerating cycle circuit R of a refrigerating cycle apparatus comprising the rotary compressor K.

First, the two-cylinder-type rotary compressor K will be described.

In the figure, 1 represents a sealed case, and in the sealed case 1, an electric motor portion 2 is accommodated in an upper part, and a compression mechanism portion 3 is accommodated in a lower part. Moreover, the compression mechanism portion 3 is soaked in an oil sump portion (not shown in the figure) of lubricating oil collecting in a bottom portion in the sealed case 1.

The electric motor portion 2 and the compression mechanism portion 3 are joined to each other through a rotation axis 4, and the electric motor portion 2 rotates the rotation axis 4 to enable the compression mechanism portion 3 to take in, compress and discharge a gas refrigerant as will be described later.

The compression mechanism portion 3 is provided with a first cylinder 5A at its upper part and a second cylinder 5B at its lower part, and an intermediate partition plate 6 is interposed between the first cylinder 5A and the second cylinder 5B.

On a top surface of the first cylinder 5A, a main bearing 7 is stacked, and the main bearing 7 is attached to an inner peripheral wall of the sealed case 1. On a bottom surface of the second cylinder 5B, an auxiliary bearing 8 is stacked, and is attached to the main bearing 7 with the second cylinder 5B, the intermediate partition plate 6 and the first cylinder 5A.

An intermediate portion of the rotation axis 4 is pivotally supported by the main bearing 7 to be rotatable, and a lower end portion thereof is pivotally supported by the auxiliary bearing 8 to be rotatable. Moreover, inside diameter portions of the first cylinder 5A, the intermediate partition plate 6 and the second cylinder 5B are penetrated, and a first eccentric portion and a second eccentric portion which have the same diameter with a phase difference of substantially 180° are integrally provided in the inside diameter portions of the first and second cylinders 5A and 5B.

On a peripheral surface of the first eccentric portion, a first roller 9*a* is fitted, and on a peripheral surface of the second eccentric portion, a second roller 9*b* is fitted. The first and second rollers 9*a* and 9*b* are accommodated to move eccentrically, such that parts of their peripheral walls come into contact with peripheral walls of the inside diameter portions of the first cylinder 5A and the second cylinder 5B, respectively, with rotation of the rotation axis 4.

The inside diameter portion of the first cylinder 5A is occluded by the main bearing 7 and the intermediate partition plate 6 to form a first cylinder chamber 10A. The inside diameter portion of the second cylinder 5B is occluded by the intermediate partition plate 6 and the auxiliary bearing 8 to form a second cylinder chamber 10B.

The diameters and the height dimensions, which are lengths in an axis direction of the rotation axis 4, of the first cylinder chamber 10A and the second cylinder chamber 10B are set at the same. The first roller 9*a* is accommodated in the first cylinder chamber 10A and the second roller 9*b* is accommodated in the second cylinder chamber 10B.

To the main bearing 7, a double discharge muffler 11 provided with a discharge hole on each side is attached, and covers a discharge valve mechanism 12*a* provided at the main bearing 7. To the auxiliary bearing 8, a single discharge muffler 13 is attached, and covers a discharge valve mechanism 12*b* provided at the auxiliary bearing 8. This discharge muffler 13 is not provided with a discharge hole.

The discharge valve mechanism 12*a* of the main bearing 7 communicates with the first cylinder chamber 10A, and opens and discharges a compressed gas refrigerant into the discharge muffler 11 when the pressure inside the cylinder chamber 10A rises to a predetermined pressure with a compression action. The discharge valve mechanism 12*b* of the auxiliary bearing 8 communicates with the second cylinder chamber 10B, and opens and discharges a compressed gas refrigerant into the discharge muffler 13 when the pressure inside the cylinder chamber 10B rises to a predetermined pressure with a compression action.

A discharge gas guide path is provided through the auxiliary bearing 8, the second cylinder 5B, the intermediate partition plate 6, the first cylinder 5A and the main bearing 7. This discharge gas guide path guides a gas refrigerant which has been compressed in the second cylinder chamber 10B and has been discharged into the discharge muffler 13 on a lower side through the discharge valve mechanism 12*b*, to the double discharge muffler 11 on an upper side.

On the other hand, the first cylinder 5A is provided with a first vane 15A and the second cylinder 5B is provided with a second vane 15B. Each of the first vane 15A and the second vane 15B is composed of two divided vanes a and b, being divided into an upper side and a lower side along a height direction of the first cylinder 5A and the second cylinder 5B, which is the axis direction of the rotation axis 4.

Back end portions of the two divided vanes a and b constituting each of the first and second vanes 15A and 150 are in contact with one end portions of coil springs (elastic members) 16 as will be described later, and the divided vanes a and b are urged to the sides of the rollers 9*a* and 9*b*.

Figure 2:
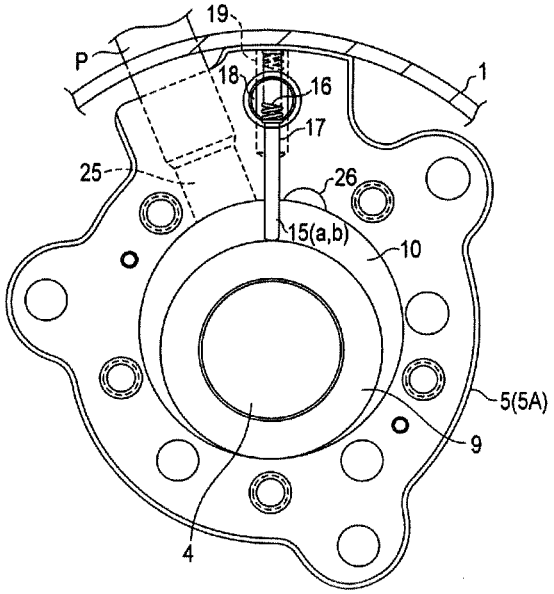
FIG. 2 is a transverse plan view of a compression mechanism portion in the rotary compressor according to the embodiment.

FIG. 2 is a plan view of the first cylinder 5A, and the second cylinder 5B not shown in the figure also has the same planar structure. Accordingly, in the description, the designations of "first" and "second" and the letters "A" and "B" are omitted (the same is applied to the following).

In the cylinder 5, a vane groove 17 opening to the cylinder chamber 10, which is an inside diameter portion, is provided in a linked manner, and moreover, a vane back chamber 18 is provided at a back end portion of the vane groove 17 in a linked manner. In the vane groove 17, the vane 15 in the state of being divided into the two upper and lower divided vanes a and b is movably accommodated in the height direction of the cylinder 5. Tip portions of the upper-side divided vane a and the lower-side divided vane b can project and sink into the cylinder chamber 10, and back end portions thereof can project and sink into the vane back chamber 18.

The tip portions of the divided vanes a and b are formed in the shape of substantially an arc in a planar view, and come into line contact with the peripheral wall of the roller 9 having the shape of a circle in planar view, regardless of a rotation angle, in the state of projecting into the cylinder chamber 10 which the tip portions face.

Furthermore, a pair of (two) spring accommodation holes 19 are provided to extend a region located just before the cylinder chamber 10, which is the inside diameter portion, through the vane back chamber 18, in parallel from an outer peripheral wall of the cylinder 5 to the side of the cylinder chamber 10, allowing a predetermined space from a substantially central portion in a thickness (axis) direction of the cylinder 5.

The coil springs 16 are accommodated in the respective spring accommodation holes 19, and one end portions of the coil springs 16 abut the inner peripheral wall of the sealed case 1 in the state of being assembled as the compression mechanism portion 3. Each of the divided vanes a and b is urged to cause the other end portions to abut the upper-side divided vane a and the lower-side divided vane b constituting the vane 15, respectively.

As shown in FIG. 1 again, a refrigerant pipe P for discharge is connected to an upper end portion of the sealed case. A condenser 20, an expansion device 21, an evaporator 22 and an accumulator 23 are provided to communicate with the refrigerant pipe P successively.

In addition, two refrigerant pipes P for intake extend from the accumulator 23, and are connected to the first cylinder 10A and the second cylinder 10B through the sealed case 1 in the rotary compressor K. In this manner, the refrigerating cycle circuit R of the refrigerating cycle apparatus is composed.

As shown in FIG. 2 again, a hole 25 for intake is provided from the outer peripheral wall of the cylinder 5 to the cylinder chamber 10, and a refrigerant pipe P for intake branching from the accumulator 23 penetrates the sealed case 1, and is inserted and fixed thereinto. The hole 25 for intake is provided on one side in a circumferential direction of the cylinder and a discharge hole 26 communicating with the discharge valve mechanism 12 is provided on the other side, such that the vane 15 and the vane groove 17 are sandwiched therebetween.

In the rotary compressor K composed in this manner, the roller 9 moves eccentrically within the cylinder chamber 10 when electricity is supplied and the rotation axis 4 rotates. The upper-side divided vane a and the lower-side divided vane b constituting the vane 15 are urged by the coil springs 16, respectively, and the tip portions of these divided vanes a and b elastically abut the peripheral wall of the roller 9.

With an eccentric movement of the roller 9, a gas refrigerant is taken in from the refrigerant pipe P for intake of the cylinder chamber 10 partitioned by the vane 15. Moreover, a gas refrigerant is moved to a compression chamber of the partitioned cylinder chamber 10, and is compressed. When the mass of the compression chamber becomes small and the pressure of the gas refrigerant rises to a predetermined pressure, the gas refrigerant is discharged from the discharge hole 26 through the discharge valve mechanism 12.

A gas refrigerant discharged from the first cylinder chamber 10A and a gas refrigerant discharged from the second cylinder chamber 10B merge in the double discharge muffler 11 on the upper side, and further, are discharged into the sealed case 1. In addition, they pervade the upper end portion of the sealed case 1 through a gas guide path provided between components constituting the electric motor portion 2, and are discharged from the refrigerant pipe P for discharge to the outside of the compressor K.

A compressed high-pressure gas refrigerant is led to the condenser 20 to be condensed, and changes into a liquid refrigerant. This liquid refrigerant is led to the expansion device 21 to be adiabatically expanded, is led to the evaporator 22 to be evaporated, and changes into a gas refrigerant. In the evaporator 22, latent heat of vaporization is removed from ambient air, and a refrigeration action is exerted.

If the rotary compressor K is mounted on an air conditioner, a cooling action is exerted. Moreover, if it is mounted on an air conditioner, a flow of a refrigerant can be switched in reverse by providing a four-way switching valve on a discharge side of the compressor K in the refrigerating cycle, and a heating action is exerted by leading a gas refrigerant discharged from the rotary compressor 1 directly to an inside heat exchanger.

Figure 3:
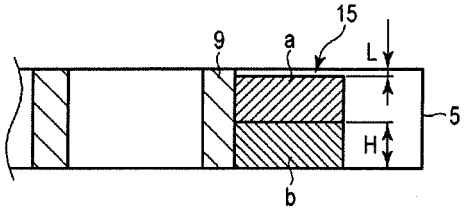
FIG. 3 is an illustration explaining a cylinder and a roller of the compression mechanism portion, and a vane structure according to the embodiment.

FIG. 3 is a longitudinal sectional view of the roller 9 and the vane 15 in the cylinder 5.

The roller 9 is accommodated in the cylinder chamber 10, which is the inside diameter portion of the cylinder 5, to be movable eccentrically as described above.

A height dimension of the roller 9 is substantially the same as a height dimension of the cylinder chamber 10 in the axis direction of the rotation axis 4. In a height direction of the roller 9, the vane 15 is stacked and disposed in the state of being divided into two vanes of the upper-side divided vane a and the lower-side divided vane b.

If it is assumed that a height dimension of each of the upper-side and lower-side divided vanes a and b is H and a minute gap which is a difference between a height dimension of the cylinder 5 and a height dimension of the two stacked upper-side and lower-side divided vanes a and b is L, the proportion of the minute gap L to the vane height dimension H per one of the upper-side and lower-side divided vanes a and b is set to satisfy the following expression:

$$0.001 < L/\text{number of divided vanes}/H < 0.0015 \quad (1)$$

Figure 4:
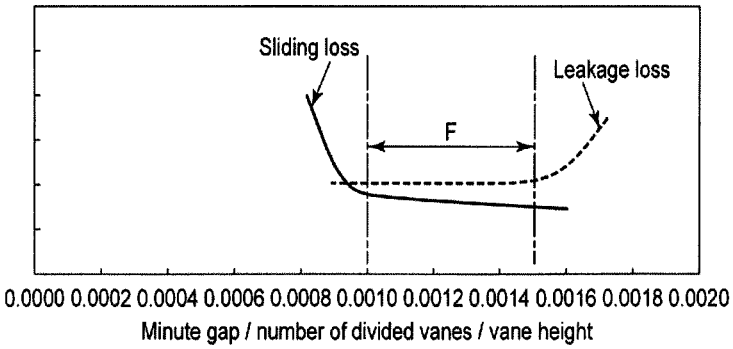
FIG. 4 is a characteristic diagram showing a relationship between a minute gap and performance according to the embodiment.
Figure 5:
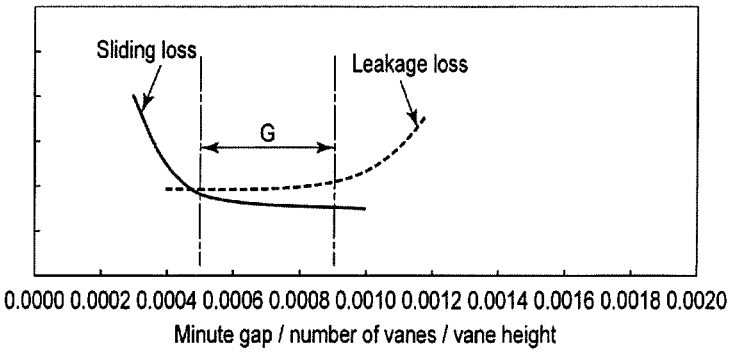
FIG. 5 is a characteristic diagram showing the relationship between a minute gap and performance in a case of providing one vane in a height direction of the cylinder as a reference example.

FIG. 4 explains expression (1) and is a characteristic view of the proportion of the minute gap L to the vane height dimension H per vane and performance according to the present embodiment. FIG. 5 is a characteristic view of the proportion of a minute gap to a vane height dimension of a conventional rotary compressor comprising one vane as a reference example.

As described above, the vane 15 partitions the cylinder chamber 10 into a compression chamber on a high-pressure side and an intake chamber on a low-pressure side. This requires that the vane 15 be elastically in sliding contact with the roller 9 moving eccentrically within the cylinder chamber 10. That is, it is necessary to make the height dimension of the roller 9 or the vane 15 smaller than the height dimension of the cylinder 5, and provide a difference in dimension (minute gap L) between them.

However, as the minute gap L becomes larger, a compressed gas refrigerant leaks out from the compression chamber (high-pressure side) to the intake chamber (low-pressure side). A compression amount per rotation of the rotation axis 4 decreases, the temperature on an intake side rises to increase a leakage loss, and a compression efficiency is impaired. On the other hand, if the minute gap L is too small, a sliding resistance at the time of reciprocation of the vane 15 remarkably increases, and thus, a compression efficiency is impaired after all.

First, an optimum range G based on a relational expression between a minute gap and a height of a vane in the case where one vane abuts a roller having a conventional structure is shown in FIG. 5 as a reference example.

A sliding loss increases as the proportion of the minute gap becomes less than 0.0005, while a leakage loss increases as the proportion of the minute gap becomes greater than 0.0009. Thus, a compressor having a good sliding performance of a vane can be provided without a decline in performance, if the conventional relational expression between a minute gap and a height of a vane satisfies:

$$0.0005<L/\text{number of vanes(one)}/H<0.0009$$

In contrast, as in the present embodiment, if the vane 15 is composed of the two divided vanes a and b and the divided vanes a and b are stacked and disposed in the height direction of the cylinder 5, it is necessary to provide a minute gap and form an oil film also on a rubbing surface between the two stacked divided vanes a and b to cause the respective divided vanes a and b to slide.

Thus, it has been proved that a minute gap (step) between the height dimension of the cylinder 5 and the height dimension of the two stacked divided vanes a and b needs to be set larger than that in the case where the number of vanes is one as shown in FIG. 5.

As shown in FIG. 4, if the proportion of the minute gap L to the vane height dimension H per one divided vane is set less than or equal to 0.0010, a sliding loss increases. Also, if the same proportion is set greater than or equal to 0.0015, a leakage loss increases.

Therefore, if the two divided vanes a and b are stacked and disposed for the roller 9, it is desirable to set the proportion of the minute gap L to the vane height dimension H per one of the divided vanes a and b within an optimum range F of 0.001<L/number of divided vanes/H<0.0015. As a concrete example, the height dimension of the cylinder 5 is 28.0 mm, the height dimension of each of the upper-side and lower-side divided vanes a and b is 13.985 mm, and the minute gap L is 0.03 mm.

Finally, by making a setting to satisfy expression (1), a sliding loss is restrained, a leakage loss is prevented, and the performance of the rotary compressor K can be used efficiently.

It should be noted that the vane 15 partitions the cylinder chamber 10 into the compression chamber and the intake chamber, and leakage of a gas refrigerant in the compression chamber to the side of the intake chamber causes a loss. In the present embodiment, because the vane 15 is divided into two vanes, the movements of the divided vanes a and b are not always the same, and an occurrence of a slight deviation cannot be prevented.

Figure 6A:
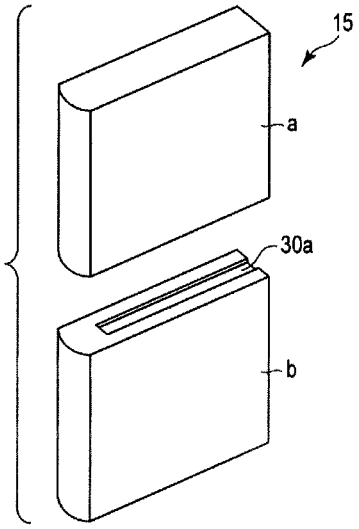
FIG. 6A is an illustration showing a different structure of an oil groove provided at a vane according to the embodiment.
Figure 6B:
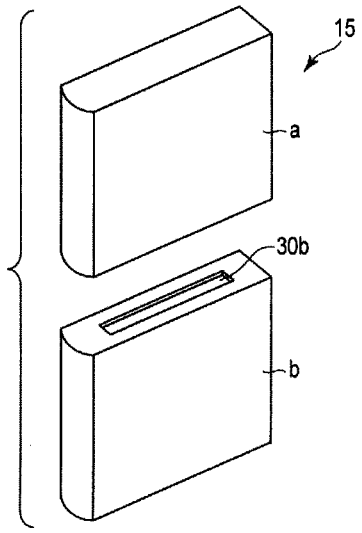
FIG. 6B is an illustration showing a different structure of an oil groove provided at the vane according to the embodiment.

FIG. 6A and FIG. 6B are perspective views of the divided vanes a and b comprising oil grooves 30*a* and 30*b* having different structures from each other.

For example, as shown in FIG. 6A, because a bottom portion of the upper-side divided vane a and a top portion of the lower-side divided vane b are stacked on each other, the oil groove 30*a* in which only a back end portion only is opened is provided at least at the top portion of the lower-side divided vane b. The same oil groove may be provided at the bottom portion of the upper-side divided vane.

Alternatively, as shown in FIG. 6B, under the same conditions, the oil groove 30*b* is provided at least at a central portion of the top portion of the lower-side divided vane b. The same oil groove may be provided at the bottom portion of the upper-side divided vane.

In any case, an oil film is always formed at a portion where the upper-side divided vane a and the lower-side divided vane b overlap. Even if a movement deviation occurs between the divided vanes a and b with a compression action, a leakage of a gas refrigerant therefrom can be restrained.

As shown in FIG. 1, in the first cylinder 5A, the coil springs 16 are provided for an upper-side divided vane a and a lower-side divided vane b constituting the first vane 15A, respectively, and urge the upper-side divided vane a and the lower-side divided vane b, respectively.

Also in the second cylinder 5B, the coil springs 16 are provided for an upper-side divided vane a and a lower-side divided vane b constituting the second vane 15B, respectively, and urge the upper-side divided vane a and the lower-side divided vane b, respectively.

In this manner, by providing the separate coil springs 16 for the upper-side divided vanes a and the lower-side divided vanes b, respectively, each of the divided vanes a and b can slide without being interfered with by each other's movement, contact force of a sliding surface between the roller 9 and each of the divided vanes a and b can be dispersed, and sliding friction can be restrained to improve reliability.

In addition, in the cylinder 5, two spring accommodation holes 19 accommodating the coil springs 16 need to be provided. In the cylinder 5, the hole 25 for intake, to which the refrigerant pipe P for intake extending from the accumulator 23 is connected, must be provided.

Furthermore, as shown in FIG. 2, the hole 25 for intake, to which the refrigerant pipe P for intake is connected, is provided at a predetermined angle on one side in the circumferential direction of the cylinder 5 and the discharge hole 26 is provided on the other side, such that the vane groove 17, to which the vane 15 is attached, and the spring accommodation holes 19 accommodating the coil springs 16 are sandwiched therebetween.

In particular, because the pipe diameter of the refrigerant pipe P for intake must be large to secure as large a refrigerant intake amount as possible, the diameter of the hole 25 for intake must be large.

The cylinder 5 is processed in the following procedure: the outer shapes of an outside diameter portion, an inside diameter portion and upper and lower surfaces are processed from casting materials, and then, a bolt hole, a gas path, a hole for vane processing (vane back chamber), the spring accommodation holes 19, the hole 25 for intake, etc., are processed. Further, following the processing of the vane groove 17, polish finishing is put on the inside diameter portion and a portion in a height direction.

In these processing steps, if the diameters of the spring accommodation holes 19 become large, the thickness of a portion of the cylinder 5 around the spring accommodation holes 19 after the processing of the spring accommodation holes 19 tends to become too thin in the height direction of the cylinder 5. Thus, a crack may open at the thin portion when the vane groove 17 is processed.

As in the present embodiment, if two divided vanes a and b are stacked and disposed in the height direction of the cylinder 5, the required number of coil springs 16 adding an elastic back pressure to the divided vanes a and b is also two, and the required number of spring accommodation holes 19 accommodating them is also two as a matter of course.

If the number of spring accommodation holes 19 provided in the height direction of the cylinder 5 is two, the thickness of a portion except the spring accommodation holes 19 in the height direction of the cylinder 5 becomes thinner, and a defect such as a crack is likely to appear.

Furthermore, the hole 25 for intake forms a predetermined angle to the spring accommodation holes 19, and is provided to penetrate from the outside diameter portion to the inside diameter portion of the cylinder 5. On the other hand, the spring accommodation holes 19 are provided from the outside diameter portion of the cylinder 5 to a middle portion in a radial direction of the cylinder 5. Thus, the positions of the tip portions of the spring accommodation holes 19 (at a middle portion of the cylinder 5) approach the hole 25 for intake the closest.

Figure 7:
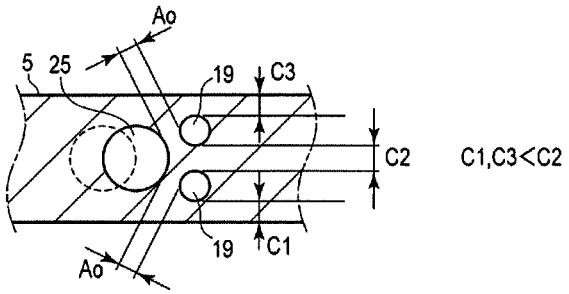
FIG. 7 is a sectional view showing a positional relationship between a hole for intake and a spring accommodation hole provided at the cylinder according to the embodiment.

FIG. 7 is a sectional view of the positions of the tip portions of the two spring accommodation holes 19 provided in the cylinder 5 and the position of the hole 25 for intake, to which the refrigerant pipe P for intake is connected, at the middle portion of the cylinder 5 according to the present embodiment. A broken-line hole having the same diameter as that of the hole 25 for intake represents a position of the hole 25 for intake opening to the outside diameter portion of the cylinder 5.

If the two spring accommodation holes 19 are provided in the height direction of the cylinder 5 and it is assumed that a distance between a lower end surface (one end surface) of the cylinder 5 and an inner surface of the spring accommodation hole 19 closer to the lower end surface is C1, a distance between inner surfaces of the two spring accommodation holes 19 is C2, and a distance between an upper end surface (the other end surface) of the cylinder 5 and the spring accommodation hole 19 closer to the upper end surface is C3, C2 is set longer than C1 or C3 (C1, C3<C2).

By virtue of this, a distance Ao between the spring accommodation holes 19 accommodating the coil springs 16 and the hole 25 for intake, to which the refrigerant pipe P guiding a gas refrigerant from the accumulator 23 is connected, can be made larger. Thus, the vane groove 17 necessary for the cylinder 5, the spring accommodation holes 19 and the hole 25 for intake can be surely processed without causing a crack in the height direction of the cylinder 5.

Figure 8:
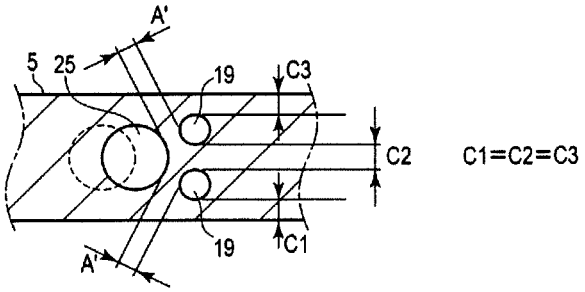
FIG. 8 is a sectional view showing the positional relationship between the hole for intake and the spring accommodation hole provided at the cylinder according to a modification of the embodiment.

FIG. 8 shows a modification, and is a sectional view of the positions of the tip portions of the spring accommodation holes 19 provided in the cylinder 5 and the position of the hole 25 for intake at the middle portion of the cylinder 5. A broken-line hole having the same diameter as that of the hole 25 for intake represents the hole for intake opening to the outside diameter portion of the cylinder 5.

In this modification, the above C1, C2 and C3 are all set at the same length (C1=C2=C3). When a distance A' between the spring accommodation holes 19 and the hole 25 for intake is sufficiently large, C1 and C3 can be made larger than those in the above embodiment of FIG. 7.

At the time of a start of the rotary compressor K, elastic force of the coil springs 16 acts as urging force to the roller 9 of the vane 15, a gas refrigerant is led to the cylinder chamber 10, and the pressure therein rises gradually.

In particular, if pressing force (elastic force) of the coil springs 16 at the time of a start is small, the vane 15 cannot follow an eccentric movement of the roller 9, and they may repeat collision and separation with each other. In this case, noise and friction occur.

When the pressure rises in the cylinder chamber 10 and a safety operation is begun, the vane 15 reciprocates with an eccentric movement of the roller 9. The coil springs 16 repeat expansion and contraction. At this time, if design dimensions of the coil springs 16 are not appropriate, buckling easily occurs, the spring accommodation holes 19 are touched, and a breakage may be eventually caused.

Figure 9A:
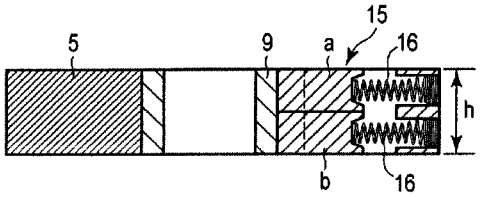
FIG. 9A is a longitudinal sectional view of a principal part of the compression mechanism portion according to the embodiment.
Figure 9B:
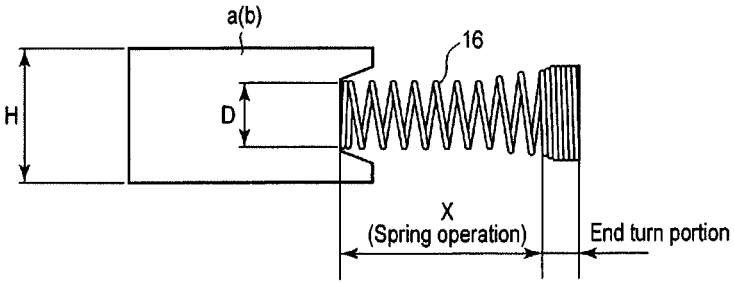
FIG. 9B is an enlarged view of a longitudinal section of the principal part of the compression mechanism portion according to the embodiment.

FIG. 9A is a longitudinal sectional view of the cylinder 5 in the compression mechanism portion 3, and FIG. 9B is a structural view of each of the coil springs 16 urging the vane 15.

The vane 15 is disposed by stacking two divided vanes a and b in the height direction of the cylinder 5. At this time, let us denote the height dimension of the cylinder 5 by "h" and the height dimension of one divided vane a, for example an upper-side divided vane, by "H".

The coil springs 16 are each composed of an end turn portion for fixation and a movable portion X capable of expansion and contraction in a length direction, and the movable portion X is an actual range of movement. If the mean diameter of the coil springs 16 is "D" and the number of coil springs 16 in the one cylinder 5 is "M", it is desirable to make a setting to satisfy the following expression:

$$D/H \geq 0.45, \text{ and } D \times M/h \leq 0.55 \quad (2)$$

$$D/H \geq 0.45 \quad (A),$$

the first structural condition, means that the mean diameter D of the coil springs 16 is set greater than the height dimension H of one divided vane a.

By way of explanation, if the wire diameter and the mean diameter of the coil springs 16 are multiplied by α, a spring constant of the coil springs 16 is also multiplied by α. Thus, in general, if the coil springs 16 are formed larger, a spring constant becomes larger, and pressing force, which is back force against the divided vane a, can be increased.

In addition, as the mean diameter D of the coil springs 16 becomes larger, two contact portions where a coil spring 16 and the divided vane a contact are separated from each other, and the divided vane a can be pressed more stably. Because L/D becomes smaller than the movable portion X having a fixed length, and it becomes hard for buckling to occur.

As a result, reciprocation of one divided vane a at the time of a start of the rotary compressor K can be stabilized. In addition, pressing force of a coil spring 16 against the one divided vane a is increased, and separation and collision between the divided vane a and the roller 9 can be prevented. Buckling occurring when the coil spring 16 expands and contracts with reciprocation of the divided vane a during compression operation can be prevented to improve reliability.

$$D \times M/h \leq 0.55 \quad (B),$$

the second structural condition, means that the mean diameter D of the coil springs 16 is made less than the height dimension h of the cylinder 5.

That is, if two divided vanes a are stacked and disposed in the height direction of the cylinder 5, the coil springs 16 become necessary for the respective divided vanes a. The spring accommodation holes 19 accommodating the coil springs 16 are also provided in the same number.

At this time, the proportion of the mean diameter D of the coil springs 16 to the height dimension h of the cylinder 5 is determined under the structural condition (B), and the spring accommodation holes 19 provided in the cylinder 5 can be reduced without being excessively enlarged.

Therefore, the diameters of the spring accommodation holes 19 provided in the cylinder 5 are not too large, the thickness of a contour portion of the cylinder 5 is secured to increase rigidity, and reliability is improved.

In this manner, by satisfying expression (2) including the structural condition (A) and the structural condition (B), the coil springs 19 stably adding a back pressure against the divided vanes a can be obtained, and reliability of reciprocation of the vanes a at the time of compression operation can be increased.

Table 1 below shows a range in which the structural condition (A) and the structural condition (B) are satisfied.

The marks ○ in Table 1 correspond to the present embodiment, in which the mean diameter of the coil springs 16 can be increased, it becomes hard for buckling to occur, and a back pressure is stably added to the divided vanes a. Because the diameters of the spring accommodation holes 19 are not excessively enlarged and the thickness of the cylinder 5 is sufficiently secured, a deformation of the cylinder 5 can be restrained small.

TABLE 1

| | | D/H | | | | | | |
|---|---|---|---|---|---|---|---|---|
| | | 0.40 | 0.410 | 0.420 | 0.430 | 0.450 | 0.470 | 0.490 |
| D × M/h | 0.510 | Δ | Δ | Δ | Δ | ○ | ○ | ○ |
| | 0.530 | Δ | Δ | Δ | Δ | ○ | ○ | ○ |
| | 0.550 | Δ | Δ | Δ | Δ | ○ | ○ | ○ |
| | 0.570 | X | X | X | X | ∇ | ∇ | ∇ |
| | 0.590 | X | X | X | X | ∇ | ∇ | ∇ |

○: Buckling does not occur and deformation of cylinder is small
Δ: Buckling occurs and deformation of cylinder is small
∇: Buckling does not occur and deformation of cylinder is large
X: Buckling occurs and deformation of cylinder is large Incidentally, as shown in FIG. 1, if the peripheral walls of the outside diameter portions of the first cylinder 5A and the second cylinder 5B are in close contact with the inner peripheral wall of the sealed case 1, one end portions of the coil springs 16 accommodated in the spring accommodation holes 19 can be pressed to the inner peripheral wall in the sealed case 1.

However, depending on a design condition of the rotary compressor K, a gap may occur between the peripheral wall of the outside diameter portion of the cylinder 5 and the inner peripheral wall of the sealed case 1. In this case, it is necessary to fit and fix end turn portions constituting the one end portions of the coil springs 16, shown in FIG. 9B, to the spring accommodation holes 19, and secure a spring range of movement, which is the movable portion X.

Also in this case, the coil spring 16 can urge the vane 15, and the roller 9 repeats reciprocation. When the roller 9 is at a lower dead-point position, the coil springs 16 are in a most extended state, and when the roller 9 is at an upper dead-point position, the coil springs 16 are in a most compressed state. When the coil springs 16 in a compressed state extend, a load is added to the end turn portions, the coil springs 16 may slip out of the spring accommodation holes 19.

In a rotary compressor of a conventional structure, one vane is provided in a height direction of a cylinder, the vane is urged by one coil spring, and a mean diameter and a wire diameter of the coil spring can be increased.

As in the present embodiment, if the vane 15 is divided into two vanes and the respective divided vanes a and b are pressed by the coil springs 16, the mean diameter and the wire diameter of the coil springs 16 necessarily become small. In particular, when the wire diameter becomes small, retention weakens, and even if the end turn portions of the coil springs 16 are fitted and fixed to the spring accommodation holes 19, they may finally slip out.

Figure 10:
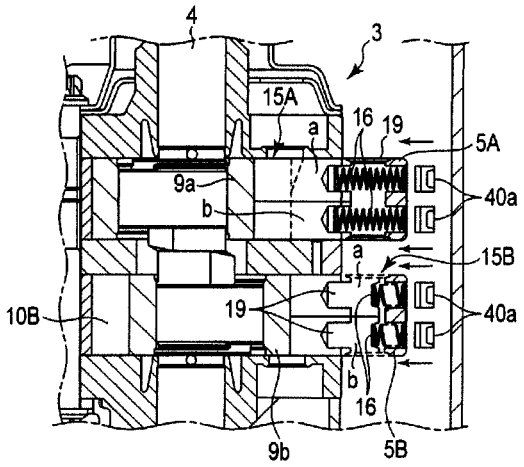
FIG. 10 is a longitudinal sectional view of the principal part of the compression mechanism portion according to a modification of the embodiment.

FIG. 10 is an illustration showing a first restraining structure to the coil springs 16 in a modification of the present embodiment.

More specifically, it is premised that there is a vacancy between the peripheral wall of the outside diameter portion of the cylinder 5 and the inside peripheral wall of the sealed case 1, and the vane 15 is disposed by stacking the divided vanes a and b in the height direction of the cylinder 5.

The coil springs 16 adding back pressure to the divided vanes a and b, respectively, are accommodated in the spring accommodation holes 19, and then, first stopper members 40*a* are pressed into the spring accommodation holes 19 opened to the outside diameter portion of the cylinder 5.

The first stopper members 40*a* are formed by bending leaf spring materials in the shape of a cylinder, and are firmly attached and fixed to the spring accommodation holes 19 by being pressed into opening ends of the spring accommodation holes 19.

Even if the coil springs 16 repeat expansion and contraction and are in a most compressed state when the upper dead-point position is reached, the first stopper members 40*a* restrain movements of the end turn portions of the coil springs 16. Thus, the coil springs 16 do not slip out of the spring accommodation holes 19, and reliability can be secured.

Figure 11:
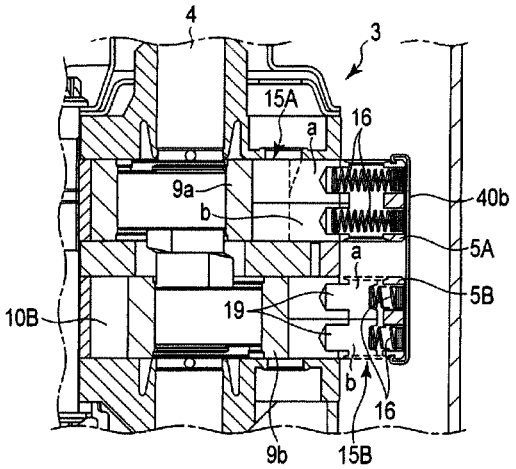
FIG. 11 is a longitudinal sectional view of the principal part of the compression mechanism portion according to another modification of the embodiment.

FIG. 11 is an illustration showing a second restraining structure to the coil springs 16 in another modification of the present embodiment.

Also in this structure, it is premised that there is a vacancy between the outside diameter portion of the cylinder 5 and the inner peripheral wall of the sealed case 1, and the two divided vanes a and b are stacked and disposed in the height direction of the cylinder 5.

The coil springs 16 adding a back pressure to the vanes a and b, respectively, are accommodated in the spring accommodation holes 19, and then, all the spring accommodation holes 19 opened to the outside diameter portion of the cylinder 5 are occluded by second stopper members 40*b*.

The second stopper members 40*b* are made of spring materials in the shape of a strip, and both the ends portions thereof are bent. These bent end portions are hooked to grooves provided at a top portion and a bottom portion of the cylinder 5, and thus can be fixed to the cylinder 5.

Even if the coil springs 16 repeat expansion and contraction and enter a most compressed state when the upper dead-point position is reached, the second stopper members 40*b* restrain movement of the end turn portions of the coil springs 16, the coil springs 16 do not slip out of the spring accommodation holes 19, and reliability can be secured.

Although not being shown in the figure, also in the case where the outside diameter portion of the cylinder 5 is in close contact with the inner peripheral wall of the sealed case 1, the coil springs 16 can be similarly prevented from slipping out of the spring accommodation holes 19 during a manufacturing process, by using the first and second stopper members 40*a* and 40*b* shown in FIG. 10 and FIG. 11.

In addition, in the rotary compressor K shown in FIG. 1, the main bearing 7 and the auxiliary bearing 8 are each composed of a pivotal support portion pivotally supporting the rotation axis 4 and a flange portion being in contact with the cylinder 5, and a ring groove d is provided at a place where the pivotal support portion and the flange portion intersect. When the rotation axis 4 bends with compression operation, the ring groove d provided at each of the main bearing 7 and the auxiliary bearing 8 is deformed and absorbs bending.

In other words, because the ring groove d is provided, the main bearing 7 and the auxiliary bearing 8 are deformed and the inclination of the roller 9 with respect to the vane 15 is increased. Contact force of the roller 9 and the vane 15 is increased, they tend to come into partial contact, and problems such as abnormal friction and baking of the vane 15 will arise in long-term use.

Figure 12:
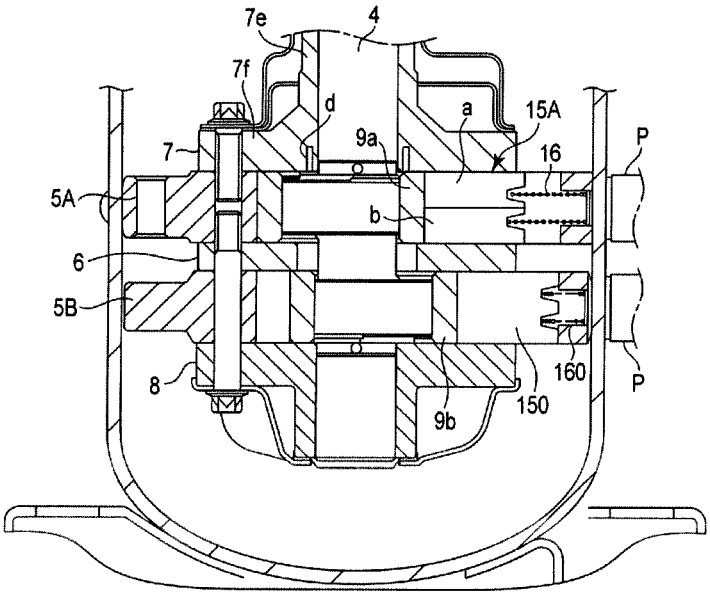
FIG. 12 is a longitudinal sectional view of the principal part of the compression mechanism portion according to another modification of the embodiment.

FIG. 12 shows an example in which the ring groove d is provided at a place where a pivotal support portion 7*e* and a flange portion 7*f* constituting the main bearing 7 intersect, while the vane 15A is disposed by stacking two vanes in the height direction of the first cylinder 5A being in contact with the main bearing 7, which is a bearing on the side on which the ring groove d is provided. Here, an example in which both of the divided vanes a and b are pressed by one coil spring 16 is shown.

Because the auxiliary bearing 8 is not provided with the ring groove d, a vane 150 attached to the second cylinder 5B is a vane composed of one vane as in the conventional art. There is no change in pressing the vane 150 by one coil spring 160.

Thus, although not being particularly shown in the figure, if the ring groove d is provided only at the auxiliary bearing 8, the vane attached to the second cylinder 5B on the side of the auxiliary bearing 8 is disposed by being divided into two vanes and stacked, and the vane attached to the first cylinder 5A being in contact with the main bearing 7 not provided with the ring groove d is a vane composed of one vane in the height direction of the cylinder 5A.

Figure 13A:
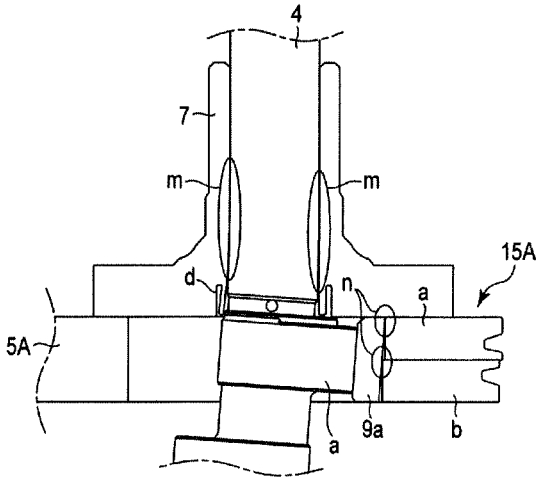
FIG. 13A is a longitudinal sectional view of the principal part of the compression mechanism portion according to another modification of the embodiment.
Figure 13B:
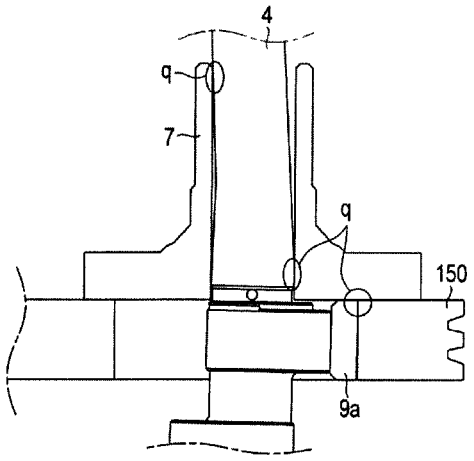
FIG. 13B is a longitudinal sectional view of a conventional structure of the principal part of the compression mechanism portion according to another modification of the embodiment.

FIG. 13A is a schematic pattern view showing how the rotation axis 4 bends in the case where the main bearing 7 is provided with the ring groove d, and FIG. 13B is a schematic pattern view in the case where the main bearing 7 is not provided with the ring groove d.

As shown in FIG. 13A, because the ring groove d is provided only at the main bearing 7, the main bearing 7 is likely to be deformed with bending of the rotation axis 4, and the rotation axis and the main bearing 7 come into contact with each other over a large area (contact ranges are denoted by m).

Therefore, contact force per unit area between the rotation axis and the main bearing 7 is relaxed and a stress concentration can be avoided. However, because the rotation axis 4 bends, the inclination of the roller 9*a* becomes large and contact force between the roller 9*a* and the vane 15*a* becomes large.

To relax this, the vane 15A provided at the first cylinder 5A on the side of the main bearing 7 provided with the ring groove d is divided, and the two divided vanes a and b are stacked and disposed in the height direction of the cylinder 5A. Accordingly, the individual divided vanes a and b come into contact with the roller 9, partial contact (partial contact portions are denoted by n) is dispersed, and a stress concentration is avoided in this structure.

FIG. 13B shows a structure in which the main bearing 7 is not provided with the ring groove d, and moreover, the vane 150 composed of one vane is provided.

Because the main bearing 7 is not provided with the ring groove d, contact (contact portions are denoted by q) is made by bending of the rotation axis 4 over a narrow range of the main bearing 7. However, because the inclination of the roller 9*a* is small, a stress concentration by contact with the roller 9*a* is small even though the vane 150 is composed of one vane.

All things considered, as shown in FIG. 12, the main bearing 7 is provided with the ring groove d, and in the first cylinder 5A on the side of the main bearing 7, the vane 15A is divided and the two divided vanes a and b are stacked and disposed in the height direction of the cylinder 5A. Because the auxiliary bearing 8 is not provided with the ring groove d, the vane 150 made of one vane may be used in the second cylinder 5B on the side of the auxiliary bearing 8.

If a vane is divided into two vanes, a processing cost, etc., add up, and thus the costs tend to increase. However, because only a blade of one cylinder is composed of two divided vanes, an increase in the costs can be restrained. As a matter of course, a vane may be made of two vanes also in the second cylinder 5B on the side of the auxiliary bearing 8.

In the above-described two-cylinder type rotary compressor, it is very desirable that at the time of activation and full blast operation, full capacity operation in which a compression action is exerted in the two cylinder chambers 10A and 10B be performed; and at the time of stable operation, a switch can be made to half-capacity operation in which a compression action is exerted in one cylinder chamber, for example, only the cylinder chamber 10A, and a compression action in the other cylinder chamber 10B is stopped.

Figure 14:
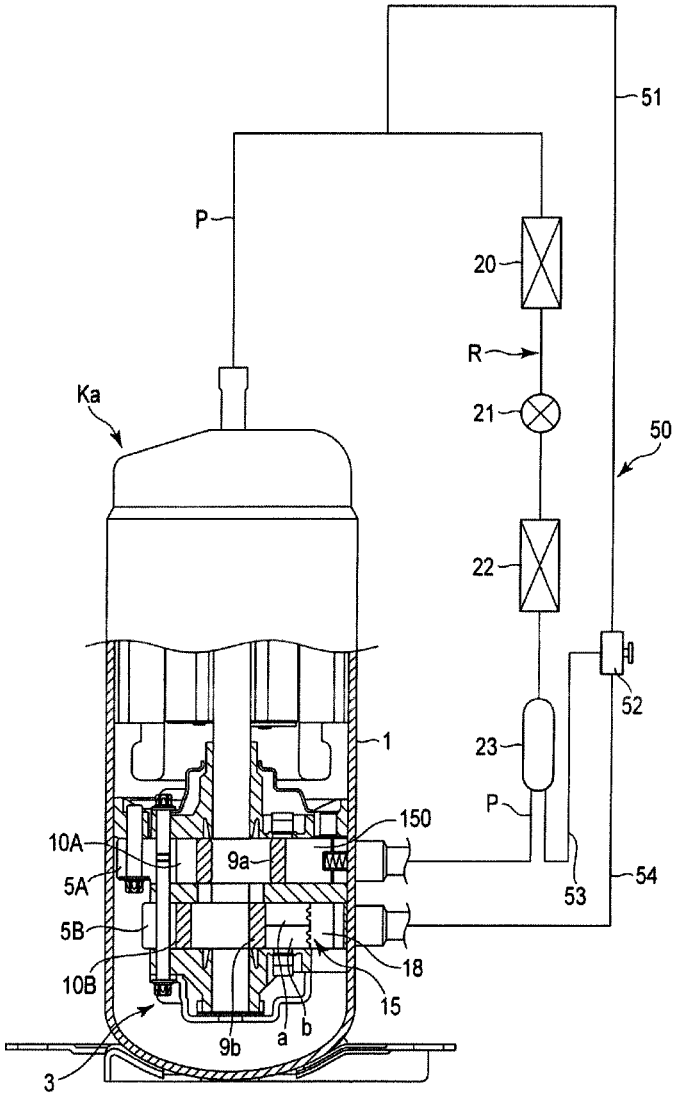
FIG. 14 is a partial longitudinal sectional view of a refrigerating cycle circuit of the refrigerating cycle apparatus, and the rotary compressor according to another modification of the embodiment.

FIG. 14 is a refrigerating cycle structural view of an air conditioner comprising a rotary compressor Ka capable of effecting switching between the above full capacity operation and half-capacity operation.

A refrigerant pipe P for discharge is connected to an upper part of the rotary compressor Ka and communicates with the first cylinder chamber 10A through a refrigerant pipe P on an intake side from the condenser 20, the expansion device 21, the evaporator 22 and the accumulator 23, and thus the refrigerating cycle circuit R is composed.

Moreover, the refrigerating cycle circuit R is provided with a pressure switch mechanism (pressure switch means) 50. More specifically, a bypass refrigerant pipe 51 branches from the refrigerant pipe P on a discharge side, and thereto, a pressure switch valve 52 which is a three-way valve is connected.

To another connection port of the pressure switch valve 52, a refrigerant pipe 53 for intake extending from the accumulator 23 is connected. Furthermore, to another connection port thereof, a bypass pipe 54 for intake which penetrates the second cylinder 5B through the sealed case 1 of the rotary compressor Ka and communicates with the second cylinder chamber 10B is connected.

The bypass refrigerant pipe 51, the pressure switch valve 52, the refrigerant pipe 53 for intake and the bypass pipe 54 for intake constitute the pressure switch mechanism 50.

The first cylinder 5A is provided with a blade back chamber, a spring accommodation hole and a coil spring at the spring accommodation hole as described above, and as in a conventional structure, the one vane 150 is brought into contact with the roller 9*a*.

The second cylinder 5B is provided with a blade back chamber 18 as described above, but is not provided with a spring accommodation hole and a coil spring. The vane 15 is disposed by stacking two vanes a and b in the height direction of the cylinder 5B. The blade back chamber 18 is opened to the inside of the sealed case 1, and each of the divided vanes a and b receives a back pressure of the pressure in the sealed case 1.

To perform full capacity operation, the pressure switch valve 52 of the pressure switch means 50 is switched to cause the accumulator 23 to communicate with the second cylinder chamber 10B through the refrigerant pipe 53 for intake, and the pressure switch valve 52 and the bypass pipe 54 for intake. Thus, a low-pressure gas refrigerant is led from the accumulator 23 to the first cylinder chamber 10A through the refrigerant pipe P for intake, is compressed therein, and is discharged into the sealed case 1.

Moreover, along a switch direction of the pressure switch valve 52, a low-pressure gas refrigerant is led from the accumulator 23 to the pressure switch valve 52 through the refrigerant pipe 53 for intake, and is led further to the second cylinder chamber 103 from the bypass pipe 54 for intake.

In the first cylinder 5A, the first vane 150 is urged by the coil spring and follows reciprocation of the roller 9*a*, and a compression action is exerted in the first cylinder chamber 10A. A gas refrigerant whose pressure has risen to a predetermined pressure is discharged into and pervades the sealed case 1, and a part thereof is led from the refrigerant pipe P for discharge to refrigerating cycle component parts such as the condenser 20 in order.

A part of the gas refrigerant pervading the sealed case 1 is led to the blade back chamber provided in the second cylinder 5B, and urges the second vane 15. Because a low-pressure gas refrigerant is led to the second cylinder chamber 10B from the bypass pipe 54 for intake, a difference of elevation appears between the tip portion and the back end portion of the vane 15, and the vane 15 reciprocates, following reciprocation of the roller 9.

With a difference in time from a start of reciprocation of the first vane 150 provided in the first cylinder 5A, reciprocation of the second vane 15 is finally started. That is, full capacity operation in which a compression action is exerted in both of the first cylinder chamber 10A and the second cylinder chamber 10B is performed.

To perform half-capacity operation, the pressure switch valve 52 is switched to cause the bypass refrigerant pipe 51 branching from the refrigerant pipe P on the discharge side to communicate with the bypass pipe 54 for intake.

While a high-pressure gas refrigerant discharged from the sealed case 1 is led to the refrigerating cycle component parts such as the condenser 20 through the refrigerant pipe P on the discharge side, a part of the gas refrigerant is split into the bypass refrigerant pipe 51. Then, through the pressure switch valve 52, it is led to the bypass pipe 54 for intake penetrating the second cylinder 5B from the sealed case 1.

A high-pressure gas refrigerant pervades the second cylinder chamber 10B and the pressure therein rises. On the other hand, the pressure in the blade back chamber 18 provided in the second cylinder 5B is at a high pressure, which is a pressure atmosphere in the sealed case 1. A tip portion and a back end portion of the second vane 15 divided into upper and lower vanes are at the same high-pressure atmosphere, and thus, a back pressure cannot be added to the roller 9B.

Finally, in the second cylinder chamber 10B in which the vane 15 is disposed by stacking two vanes in the height direction of the cylinder 5B, cylinder deactivated operation in which a compression action is not exerted is performed, and half-capacity operation in which a compression action is exerted only in the first cylinder chamber 10A is performed.

Figure 15:
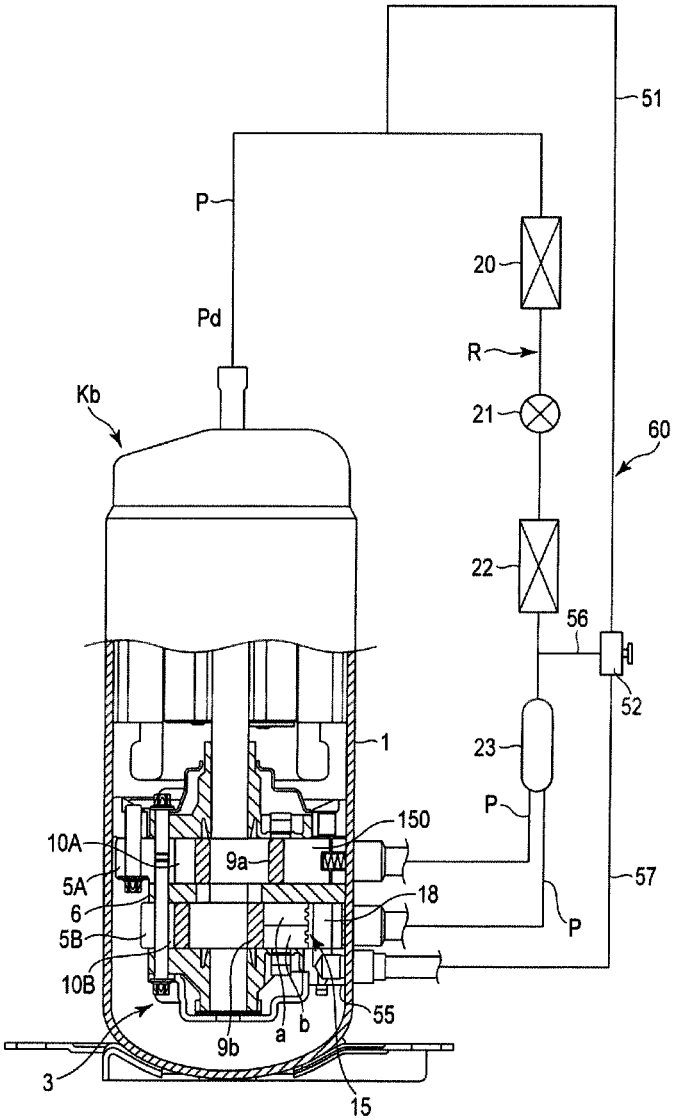
FIG. 15 is a partial longitudinal sectional view of the refrigerating cycle circuit of the refrigerating cycle apparatus, and the rotary compressor according to another modification of the embodiment.

A rotary compressor Kb shown in FIG. 15 assumes a different form from that of the rotary compressor Ka described above with reference to FIG. 14, but is capable of effecting switching between full capacity operation and half-capacity operation too.

The structure of the first cylinder 5A is exactly the same, and one first vane 150 is provided and is brought into contact with the roller 9*a* by one coil spring. A refrigerant pipe P for intake extending from the accumulator 23 communicates with the first cylinder chamber 10A.

Here, the refrigerant pipe P for intake extending from the accumulator 23 communicates also with the second cylinder chamber 10B. The second vane 15 is disposed by stacking two divided vanes a and b in the height direction of the second cylinder 5B. To the second vane 15, a back pressure is added by a back pressure addition portion 55 communicating with the vane back chamber 18 of the second cylinder 5B.

More specifically, the back pressure addition portion 55 is attached to a bottom portion of the second cylinder 5B, and covers and occludes a bottom portion of the vane back chamber 18. Because a top portion of the vane back chamber 18 is occluded by the intermediate partition plate 6, it is not opened to the sealed case 1 as in the structure described with reference to FIG. 14 and receives a pressure to be a back pressure from the back pressure addition portion 55.

A refrigerating cycle component device communicates with the refrigerant pipe P for discharge of the sealed case 1 and constitutes the refrigerating cycle circuit R. The bypass refrigerant pipe 51 branches to the refrigerant pipe P for discharge, and the pressure switch valve 52, which is a three-way valve, is provided therein.

A branch pipe 56 branching between the evaporator 22 and the accumulator 23 is connected to one connection port of the pressure switch valve 52, and a branch bypass pipe 57 communicating with the back pressure addition portion 55, described above, is connected to another connection port thereof.

The bypass refrigerant pipe 51, the pressure switch valve 52, the branch pipe 56, the branch bypass pipe 57 and the back pressure addition portion 55 constitute a pressure switch mechanism (pressure switch means) 60.

At the time of full capacity operation, the first cylinder chamber 10A compresses, pressurizes and discharges a low-pressure gas refrigerant led from a refrigerating cycle component part. A part of a high-pressure gas refrigerant led from the refrigerant pipe P on the discharge side is split from the refrigerant pipe P on the discharge side by a switch of the pressure switch valve 52, and is led to the back pressure addition portion 55 from the branch bypass pipe 57.

While a high-pressure gas refrigerant pervades the second vane back chamber 18 provided with the back pressure addition portion 55, a low-pressure gas refrigerant pervades the second cylinder chamber 10B through the refrigerant pipe P for intake from the accumulator 23. A difference in pressure occurs between the tip portion and the back end portion of the second vane 15, and the second vane 15 reciprocates, following an eccentric movement of the roller 9*b*.

With a difference in time from a start of reciprocation of the first vane 150 provided in the first cylinder 5A, reciprocation of the second vane 15 is started in the end. Thus, full capacity operation in which a compression action is exerted in the second cylinder chamber 10B as well as the first cylinder chamber 10A is performed.

To perform half-capacity operation, a switch is made, such that a low-pressure gas refrigerant is split from the evaporator 22 and is led to the back pressure addition portion 55 through the bypass pipe 57 for intake. While the second vane back chamber 18 provided with the back pressure addition portion 55 comes to have a low-pressure atmosphere, a low-pressure gas refrigerant is led to the second cylinder chamber 10B from the accumulator 23 through the refrigerant pipe P for intake.

Because the tip portion and the back end portion of the second vane 15 divided into upper and lower vanes are in the same low-pressure atmosphere, a back pressure to the roller 9*b* cannot be added. Finally, in the second cylinder chamber 10B in which the two divided vanes a and b are stacked and disposed in the height direction of the cylinder 5B, cylinder deactivated operation in which a compression action is not exerted is performed, and half-capacity operation in which a compression action is exerted only in the first cylinder chamber 10A is performed.

In each of the rotary compressors Ka and Kb of FIG. 14 and FIG. 15, the vane 15 provided in the second cylinder 5B is disposed by stacking two vanes in the height direction of the cylinder 5B, and the pressure switch mechanism 50 or 60 is provided in the refrigerating cycle circuit R. In each case, at the time of half-capacity operation, the tip portion and the back end portion of the vane 15 are in the same pressure atmosphere, and cylinder deactivated operation is performed.

At the time of full capacity operation, a differential pressure occurs between the tip portion and the back end portion of the vane 15, and the vane 15 reciprocates following an eccentric movement of the roller 9*b*, and a gas refrigerant is compressed in the second cylinder chamber 10B. A pressure necessary for controlling a following state of the vane 15 is determined based on inertial force of the vane 15, spring force of the coil springs 16 and viscous force of lubricant oil, and is set to satisfy the following expression:

force generated by differential pressure+spring force>inertial force of a vane+viscous force of lubricant oil (3)

In a common rotary compressor, a coil spring is used, and spring force is necessarily adjusted to surpass inertial force of a vane and viscous force of lubricant oil. In the structures of FIG. 14 and FIG. 15 if a coil spring is not used and lubricant oil has constant viscous force, inertial force of the vane 15 must be surpassed only by force generated by a differential pressure. In a certain pressure state, or with a certain number of rotations, the pressure switch mechanisms 50 and 60 may not make a pressure switch smoothly.

Once the operation of the rotary compressor Ka or Kb is started, the rotation axis 4 causes a swing of a rotator of the electric motor portion 2, or a slight inclination due to a differential pressure in the cylinder chamber 10. Because of this inclination, sealing characteristics between the roller 9 and the vane 15 deteriorate and degradation of performance is caused.

The inertial force of the vane 15 can be determined based on the following expression:

$$Fb=W\times\alpha \quad (4)$$

where Fb is the inertial force of a vane, W is the mass of a vane, and $\alpha$ is the acceleration in a sliding direction of a vane.

The acceleration $\alpha$ in the sliding direction of the vane 15 can be determined by the second order derivative of a displacement in the sliding direction of the vane 15. The mass of the vane 15 is multiplied by one half if two vanes are stacked, or is multiplied by one third if three vanes are stacked, and thus, can be easily reduced. Consequently, by dividing the vane 15, the inertial force can be reduced and switching characteristics can be improved.

In the case of the rotary compressors Ka and Kb, the rotation axis 4 causes a swing of the electric motor portion 2 or a slight inclination due to a differential pressure of the cylinder chamber 10. In the cylinder chamber 10B provided with the vane 15 reciprocating because of a differential pressure between its tip portion and back end portion, two divided vanes a and b are stacked and disposed in the height direction of the cylinder 5B. Thus, a sealing width between the divided vanes a and b and the roller 9 is doubled, and sealing characteristics can be improved.

In addition, although not being particularly shown in the figures, in FIG. 14 and FIG. 15, the vane 150 provided in the first cylinder 5A not communicating with the pressure switch mechanism also may be disposed by stacking two divided vanes a and b in the height direction of the cylinder 5A.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

According to the present invention, a rotary compressor in which a vane is divided into two vanes, a leakage loss of a gas refrigerant to an intake chamber from a compression chamber in a cylinder chamber is restrained, and a smooth movement of a roller can be surly obtained without an increase in a sliding loss between the divided vanes and the roller; and a refrigerating cycle apparatus comprising the rotary compressor can be obtained.

What is claimed is:

1. A rotary compressor comprising an electric motor portion and a compression mechanism portion joined to the electric motor portion through a rotation axis in a sealed case, wherein the compression mechanism portion comprises a main bearing and an auxiliary bearing pivotally supporting the rotation axis, first and second cylinders between the main bearing and the auxiliary bearing, and an intermediate partition plate interposed between the first and second cylinders, the first cylinder comprises a first cylinder chamber, a first roller moving eccentrically within the first cylinder chamber, and a first vane abutting the first roller and partitioning an inside of the first cylinder chamber into a first compression chamber and a first intake chamber, the second cylinder comprises a second cylinder chamber, a second roller moving eccentrically within the second cylinder chamber, and a second vane abutting the second roller and partitioning an inside of the second cylinder chamber into a second compression chamber and a second intake chamber, the main bearing includes a first ring groove, the auxiliary bearing includes a second ring groove, the first vane is disposed by stacking first and second divided vanes in a height direction of the first cylinder, which is an axis direction of the rotation axis, the second vane is disposed by stacking third and fourth divided vanes in a height direction of the second cylinder, which is the axis direction of the rotation axis, where a height dimension of the first divided vane is H, a height dimension of the second divided vane is H, and a minute gap between a height dimension of the first cylinder and a height dimension of the stacked first and second divided vanes is L, a proportion of the minute gap L to the height dimension H per one divided vane is set to satisfy an expression (1) below, and where a height dimension of the third divided vane is H, a height dimension of the fourth divided vane is H, and a minute gap between a height dimension of the second cylinder and a height dimension of the stacked third and fourth divided vanes is L, a proportion of the minute gap L to the height dimension H per one divided vane is set to satisfy the expression (1) below, $$0.001<L/\text{number of divided vanes}/H<0.0015 \quad (1).$$

2. The rotary compressor of claim 1, wherein first coil springs are provided for the first and second divided vanes constituting the first vane, respectively, to elastically press the first and second divided vanes against the first roller, and second coil springs are provided for the third and fourth divided vanes constituting the second vane, respectively, to elastically press the third and fourth divided vanes against the second roller.

3. The rotary compressor of claim 2, wherein the first cylinder is provided with: two first spring accommodation holes accommodating the respective first coil springs, the first spring accommodation holes being separated from each other in the height direction of the first cylinder; and a first hole for intake for leading a gas refrigerant to the first cylinder chamber, the first hole for intake forming a predetermined angle in a circumferential direction of the first cylinder with the first spring accommodation holes, the second cylinder is provided with: two second spring accommodation holes accommodating the respective second coil springs, the second spring accommodation holes being separated from each other in the height direction of the second cylinder; and a second hole for intake for leading a gas refrigerant to the second cylinder chamber, the second hole for intake forming a predetermined angle in a circumferential direction of the second cylinder with the second spring accommodation holes, where in the height direction of the first cylinder, a distance between one end surface of the first cylinder and an inner surface of the first spring accommodation hole amongst the two first spring accommodation holes that is closer to the one end surface is C1, a distance between inner surfaces of the two first spring accommodation holes is C2, and a distance between an other end surface of the cylinder and the inner surface of the first spring accommodation hole amongst the two first spring accommodation holes that is closer to the other end surface is C3, a length dimension of C2 is set larger than C1 or C3, where in the height direction of the second cylinder, a distance between one end surface of the second cylinder and an inner surface of the second spring accommodation hole amongst the two second spring accommodation holes that is closer to the one end surface is C1, a distance between inner surfaces of the two second spring accommodation holes is C2, and a distance between an other end surface of the second cylinder and the inner surface of the second spring accommodation hole amongst the two second spring accommodation holes that is closer to the other end surface is C3, a length dimension of C2 is set larger than C1 or C3.

4. The rotary compressor of claim 3, wherein cylinder opening ends of the first spring accommodation holes are provided with first stopper members stopping the first coil springs from slipping, and cylinder opening ends of the second spring accommodation holes are provided with second stopper members stopping the second coil springs from slipping.

5. A refrigerating cycle apparatus constituting a refrigerating cycle circuit comprising the rotary compressor of claim 4, a condenser, an expansion device and an evaporator connected through a refrigerant pipe.

6. A refrigerating cycle apparatus constituting a refrigerating cycle circuit comprising the rotary compressor of claim 3, a condenser, an expansion device and an evaporator connected through a refrigerant pipe.

7. The rotary compressor of claim 2, wherein where a mean diameter of the first coil springs is D, the height dimension of the first divided vane is H, the height dimension of the first cylinder is h, and the number of the first coil springs is M, an expression (2) below is satisfied, and where a mean diameter of the second coil springs is D, the height dimension of the third divided vane is H, the height dimension of the fourth divided vane is H, the height dimension of the second cylinder is h, and the number of the second coil springs is M, the expression (2) below is satisfied:

$$D/H \geq 0.45, \text{ and } D \times M/h \leq 0.55 \quad (2).$$

8. A refrigerating cycle apparatus constituting a refrigerating cycle circuit comprising the rotary compressor of claim 7, a condenser, an expansion device and an evaporator connected through a refrigerant pipe.

9. A refrigerating cycle apparatus constituting a refrigerating cycle circuit comprising the rotary compressor of claim 2, a condenser, an expansion device and an evaporator connected through a refrigerant pipe.

10. A refrigerating cycle apparatus constituting a refrigerating cycle circuit comprising the rotary compressor of claim 1, a condenser, an expansion device and an evaporator connected through a refrigerant pipe.

* * * * *